US005568953A

United States Patent [19]

Showalter

[11] Patent Number: 5,568,953

[45] Date of Patent: Oct. 29, 1996

[54] RETAINING LATCH FOR GOLFCART HINGED WINDSHIELDS

[75] Inventor: Jerry M. Showalter, Wesley Chapel, Fla.

[73] Assignee: Tampa G Manufacturing Co., Tampa, Fla.

[21] Appl. No.: 303,525

[22] Filed: Sep. 9, 1994

[51] Int. Cl.[6] ..... E05C 3/02

[52] U.S. Cl. ..... 292/194; 292/101; 292/202

[58] Field of Search ..... 292/194, 56, 101, 292/241, DIG. 7, DIG. 6, 202, DIG. 30, DIG. 20

[56] References Cited

U.S. PATENT DOCUMENTS

| | | | |
|---|---|---|---|
| 395,129 | 12/1888 | Gardner et al. | 292/202 |
| 998,592 | 7/1911 | Shrauger | 292/202 |
| 1,068,466 | 7/1913 | Underwood | 292/101 |
| 1,688,543 | 10/1928 | Highers | 292/101 X |
| 3,997,205 | 12/1976 | MacDonald | 292/288 |

FOREIGN PATENT DOCUMENTS

| | | | |
|---|---|---|---|
| 14628 | 7/1905 | United Kingdom | 292/202 |

*Primary Examiner*—Rodney M. Lindsey
*Attorney, Agent, or Firm*—Dominik & Stein

[57] ABSTRACT

The latch is S-shaped and attachable to roof structure supports for the roof of the golf cart. The S-shape is defined by a first outer transverse member, a first outer longitudinal member, a middle transverse member, a second outer longitudinal member and a second outer transverse member, each member positioned in the same plane. The first outer transverse member, the first outer longitudinal member and the middle transverse member define a first lobe. The first lobe is rotatable to engage the windshield by a second lobe defined by the middle transverse member, second outer longitudinal member and second outer transverse member, the second lobe functioning as a handle.

9 Claims, 2 Drawing Sheets

RETAINING LATCH FOR GOLFCART HINGED WINDSHIELDS

BACKGROUND OF THE INVENTION

1. Field of the Invention

This invention relates to hinged windshields for golf carts. More particularly, this invention relates to retaining latches for golf cart windshields that retain the windshields in their upright, closed position about the front of the golf cart.

2. Description of the Background Art

Golf carts are typically motorized vehicles, gas or electric, that comprise a body portion including a driver's seat and a passenger seat with a storage area in the rear for storing a pair of golf bags in an upright position. Most golf carts include a roof structure positioned above the body portion by means of four upright corner supports. The roof structure provides at least partial protection to the golfers in the golf cart during inclement weather such as rain, and also at least partially shades the golfers during sunny weather.

Golf cart roof structures do not provide complete protection since the front, rear and sides are open. Accordingly, there presently exist numerous types of enclosures for golf carts which are designed to provide added protection to the golfers seated therein. Generally, golf cart enclosures are composed of a canvas or vinyl material having a plurality of panels which are configured to be supported about the front, rear and side openings of the golf cart. The panels in some of these enclosures are suspended directly from the roof structure of the golf cart whereas others are suspended from a canvas or vinyl roof panel designed to be positioned over the roof structure of a golf cart so that the panels are suspended downwardly therefrom about the front, rear and side openings of the golf cart. Various means are provided for securing the lower edges of the panels to the lower edges of the golf cart in order to retain them in proper position. Most importantly, the front and typically the rear and side panels include sections of transparent vinyl which function as windshields or windows permitting the golfers to see out of the golf cart when fully enclosed in the enclosure. Representative golf cart enclosures are described and illustrated in U.S. Pat. Nos. 5,259,656, 4,621,859, 5,310,235, 4,773,694, 4,098,536 and 4,488,750, the disclosures of which are hereby incorporated by reference herein.

The earliest models of golf cart enclosures included four panels (front, rear and side panels) as described above. However, it was soon realized that most golfers kept the front panel rolled down to function as a windshield even during good weather conditions. Golfers particularly favored keeping the front panel rolled down to function as a windshield to block the flow of air during operation of the golf cart. These front panels soon became known as "soft" fronts or windshields, and were particularly favored by golfers during cooler weather and light rain, because the soft windshield sufficiently deflected oncoming air to keep the golfers comfortable during movement of the golf cart. In many situations, the soft windshields were left in place almost year round.

Windshields composed of transparent hard materials such as a transparent acrylic or glass, for golf carts were soon developed. These became known as "hard" windshields to distinguish them from the "soft" windshields composed of the transparent vinyl front panel of a golf cart enclosure. Indeed, golf cart enclosures were soon being manufactured as "four-sided" versions with a front panel having a soft front or windshield, paired side panels, and a rear panel and "three-sided" versions having only side panels and a rear panel intended to be used on golf carts with hard windshields.

Presently, there exists many types of hard windshields. Some are composed simply of a flat, hard transparent material that is permanently affixed to the front roof structure supports, others are entirely removable and still others are connected to the roof structure supports in such a manner that the windshield may be rolled out of the way up under the roof structure. Representative windshields for golf carts are described and illustrated in U.S. Pat. Nos. 5,195,797, 5,192,109, 5,110,174, 4,819,979, 4,795,205, 4,792,175, 4,773,695, 4,343,503, 4,014,589 and 3,958,826, the disclosures of which are hereby incorporated by reference herein.

One particular type of hard windshield consists of lower and upper sheets of transparent material, such as clear acrylic or Lexan, that are dimensioned to be positioned about the lower and upper openings of the golf cart, with the sides thereof secured to the left and right front roof structure supports, thereby functioning as lower and upper windshields. The mating edges of the lower and upper windshields are hingely connected together such as by means of a living hinge or the like. The opposing sides of the lower windshield are permanently secured to the front upstanding roof supports by means of threaded fasteners, rivets, or the like. Because of the living hinge, the upper windshield is permitted to fold down over the lower windshield in a stacked, parallel configuration such that the upper area of the front of the golf cart is "open". When desired, the upper windshield may then be pivoted upwardly to a position substantially planar with the lower windshield, thereby "closing" the upper area of the front of the golf cart. Fastener means are provided for securing the upper windshield in such a "closed" position. In the industry, these types of windshields became known as "hinged windshields".

Presently, there exists numerous means for securing the upper windshield of the hinged windshield of the golf cart to the front upstanding supports of the roof structure. Historically, a hook and loop fastener such as that known by the trademark "Velcro" was first used by adhering one component of the fastener (hook or loop) to the opposing side edges of the upper windshield and adhering the other component or the fastener (loop or hook) to the front surface of the front roof structure supports. In this manner, as the upper windshield is moved to the vertical, closed position, the components of the hook and loop fastener are engaged and securely retains the upper windshield in the closed position. Unfortunately, however, due to the nature of the hook and loop fasteners, it is sometimes difficult for the golfer to pull the hook and loop fastener apart in order to lower the upper windshield.

Another type of fastener for golf cart hinged windshields comprises generally U-shaped retainer clips that are dimensioned and configured to resiliently grasp about the roof structure supports. Typically, one of these U-shaped clips is rigidly connected to each opposing side of the upper windshield such that when the upper windshield is closed, the U-shaped retainer clips snaps onto their respective roof structure supports, thereby securing the upper windshield in its closed position. Importantly, the golfer can easily open the windshield since U-shaped clips of this structure can more easily release from the upstanding supports than hook and loop type fasteners.

Still another type of fastener for golf cart hinged windshields comprises a rubber latch. Rubber latches of this type are permanently affixed to the front roof structure supports.

They include an L-shaped or U-shaped configuration that can be bent backward during closing of the upper windshield and then released to resiliently engage the opposing side edges of the upper windshield when closed. Unfortunately, rubber latches of this character tend to lose their inherent "memory" after repeated use thereby requiring replacement.

Still other types of fasteners for golf cart hinged windshields include articulated knobs or latches positioned through holes in the opposing sides of the upper windshield in such manner that when the upper windshield is closed, the knob or latch can be operated to rigidly engage into a hole in the supports or a bracket affixed to the supports, respectively. Unfortunately, articulated knobs and latches of this character require holes to be drilled through the opposing sides of the upper windshield, thereby increasing the manufacturing cost since acrylic is notch sensitive and relatively brittle. Moreover, repeated operation of the knob or latch of this character sometimes results in a degradation of the hole in the acrylic.

Therefore, it is an object of this invention to provide an improvement which overcomes the aforementioned inadequacies of the prior art devices and provides an improvement which is a significant contribution to the advancement of the golf cart windshield art.

Another object of this invention is to provide an improved retaining latch for use in connection with a hinged windshield for a golf cart, the hinged windshield having a portion overlying the front of a roof structure support, the retaining latch comprising a squared S-shaped latch having serially connected first outer transverse member, first outer longitudinal member, middle transverse member, second outer transverse member and second outer transverse member that define a squared "S" configuration; and means for clamping one of the outer longitudinal members to a side of the support, whereby a first lobe defined by the first outer transverse member, first outer longitudinal member, and middle transverse member of the squared S-shaped latch is positioned about the support with the clamp means being positioned over the first outer longitudinal member and secured to a side of the support, whereby a second lobe defined by the middle transverse member, second outer transverse member and second outer transverse member functions as a handle that can be easily grasped and twisted such that the first outer transverse member moves across the front of the closed upper windshield to securely retain the upper windshield in the closed position and whereby the upper windshield may be released by grasping the second lobe and twisting it until the first outer transverse member pivots away from the front of the upper windshield.

The foregoing has outlined some of the pertinent objects of the invention. These objects should be construed to merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention and the detailed description of the preferred embodiment in addition to the scope of the invention defined by the claims taken in conjunction with the accompanying drawings.

SUMMARY OF THE INVENTION

For the purpose of summarizing this invention, this invention comprises an improved retaining latch for golf cart hinged windshields. More particularly, the retaining latch of this invention comprises a generally squared S-shaped latch and means for pivotally securing one of the outer longitudinal members of the squared S-shaped latch to the upstanding support of the roof structure of the golf cart in such a manner that one outer transverse member of the squared S-shaped latch functions as a handle for the golfer to twist and such that the other outer transverse member of the squared S-shaped latch functions as a latch that is pivoted, during twisting of the handle transverse member, across the opposing side edges of the closed upper windshield, thereby securing the windshield in its closed position. The retaining latch of the invention is not only simple in design and therefore economical to manufacture, but is also elegant in function.

Significantly, because the squared S-shaped latch is configured as a squared "S", one lobe of the squared "S" may be of a larger dimension than the other lobe of the squared "S". With differently-sized lobes, each lobe being properly dimensioned to fit a specific size of roof structure support, the same squared S-shaped latch may be used on different makes or models of golf carts that have roof structure supports that differ in size from one make or model to the other. Inventory costs are therefore minimized.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
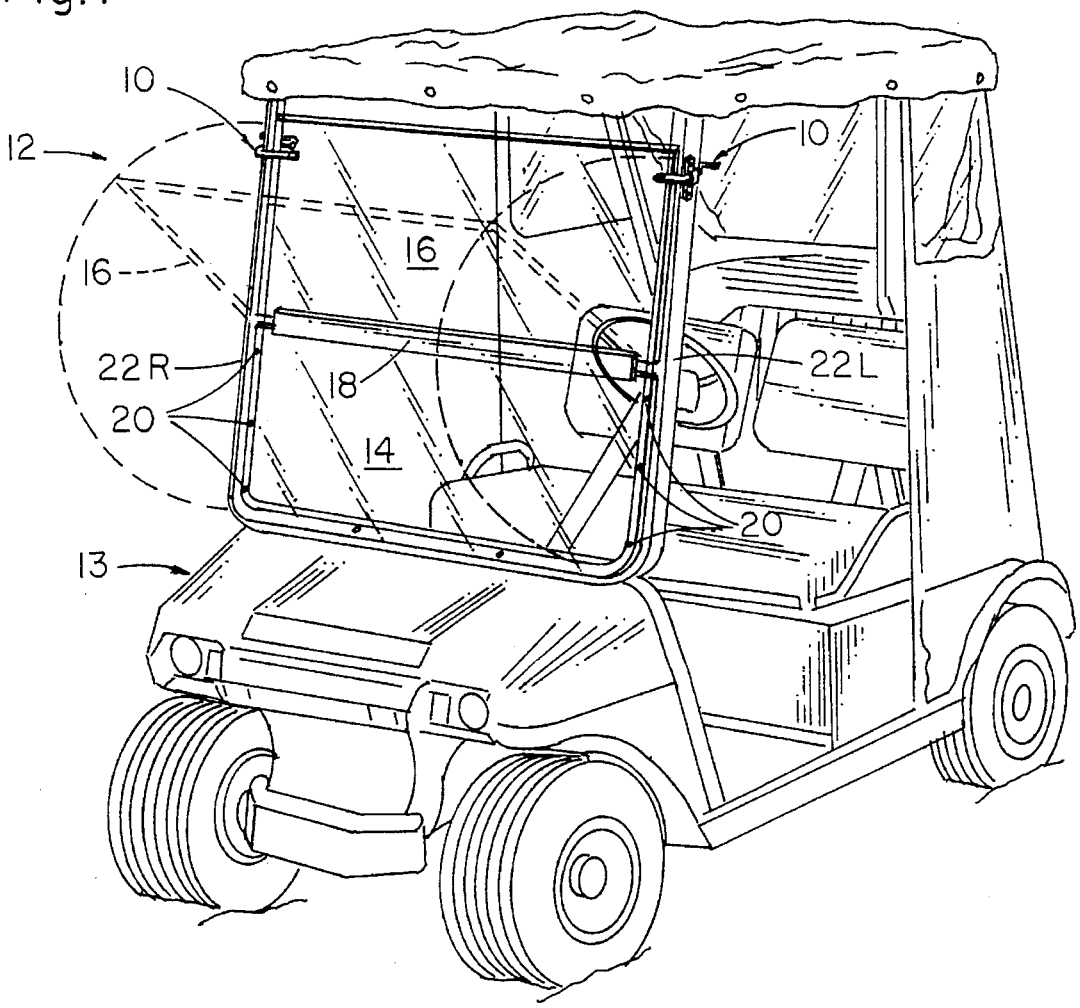
FIG. 1 is a perspective view of a golf cart illustrating a hinged windshield in its closed position with the upper windshield folded upwardly to a position planar to the lower windshield and illustrating in phantom, the opened position of the hinged windshield with the upper windshield thereof being folded onto the lower windshield thereof in a stacked arrangement.

Referring to FIG. 1, the retainer latch 10 of the invention is intended to be used in conjunction with a hinged windshield, generally indicated by numeral 12, for a golf cart 13. The hinged windshield 12 comprises a lower windshield 14 hingely connected to an upper windshield 16 by means of a hinge 18 such as living hinge. The lower windshield 14 spans across the front opening of the golf cart 13 and is rigidly connected by means of fasteners 20 to the left roof structure support 22L and to the right roof structure support 22R. The upper windshield 16 is in a closed position when it is hinged upwardly to be substantially planar with the lower windshield 14. As shown in phantom in FIG. 1, the upper windshield 16 will be in an opened position when it is positioned adjacent to the lower windshield 14 in a stacked configuration.

Figure 2:
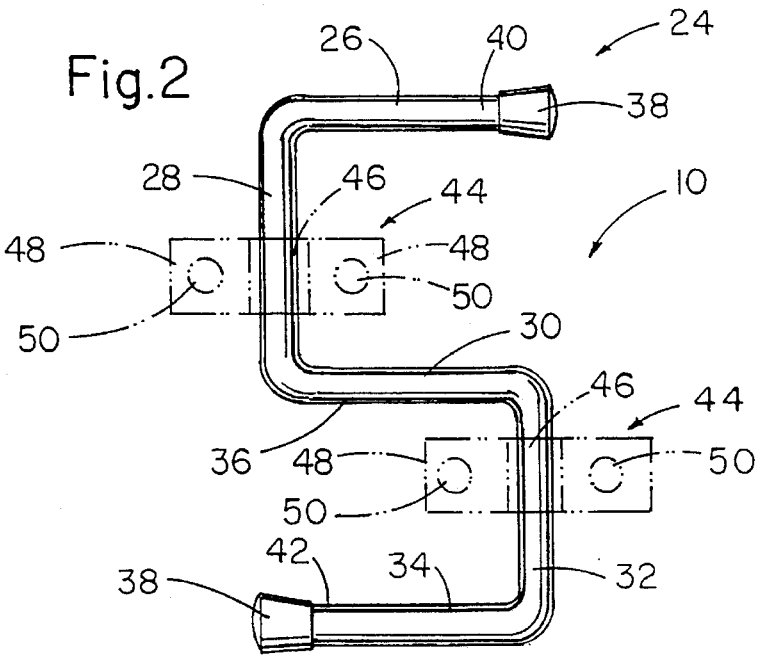
FIG. 2 is a plan view of the squared S-shaped latch of the invention illustrating the transverse and longitudinal members thereof and illustrating in phantom the two possible positions of the retaining clamp on one or the other longitudinal members of the squared S-shaped latch for pivotally securing the squared S-shaped latch to the roof structure support.

The retainer latch 10 of the invention functions to retain the upper windshield 16 in its closed position. As best shown in FIG. 2, the retaining latch 10 comprises a squared S-shaped latch 24 having serially connected first outer transverse member 26, first outer longitudinal member 28, middle transverse member 30, second outer transverse member 32 and second outer transverse member 34 positioned in a plane and perpendicular to adjacent members to define the squared "S" configuration. The members 26–34 are preferably made from round rod stock bent into the squared "S" configuration. However, square cross-sectional stock will suffice. Further, members 26–34 are preferably coated with plastic 36 or other material to prevent rusting while providing a more aesthetically pleasing appearance. Finally, end caps 38 are preferably positioned over the first terminal end 40 of the first outer transverse member 26 and the second terminal end 42 of the second outer transverse member 34.

The retainer latch 10 of the invention further comprises a pivot clamp 44 having a U-shaped center portion 46 and one or two end portions 48. Holes 50 are provided in the end portions 48 for receiving a fastener 52 for securing the clamp 44 to the support 22. It is noted that other types of fasteners 52 may be provided for pivotally fastening the squared S-shaped latch 24 to the roof structure support 22.

Figure 3:
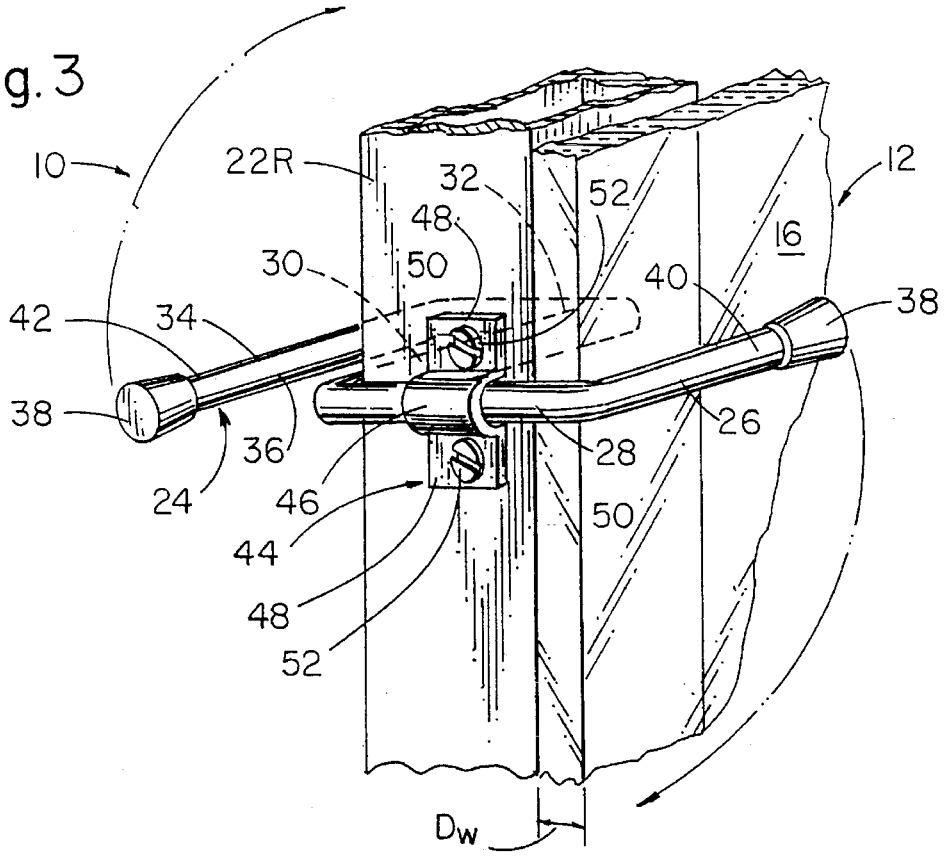
FIG. 3 is an enlarged partial cross-sectional view of the front support of a golf cart illustrating a hinged windshield secured in its closed position by means of the retaining latch of the invention.

As shown in FIG. 3, the squared S-shaped latch 24 is positioned such that the first lobe defined by the first outer transverse member 26, first outer longitudinal member 28, and middle transverse member 30 is positioned about the roof structure support 22. The center portion 46 of the clamp 44 is then positioned over the first outer longitudinal member 28 and secured to the roof structure support 22 by means of the fastener 52. When thus positioned, the second lobe defined by the middle transverse member 30, second outer transverse member 32 and second outer transverse member 34 functions as a handle that can be easily grasped by the golfer and twisted such that the first outer transverse member 26 moves across the front of the closed upper windshield 16 to securely retain the upper windshield 16 in its closed position.

Figure 4:
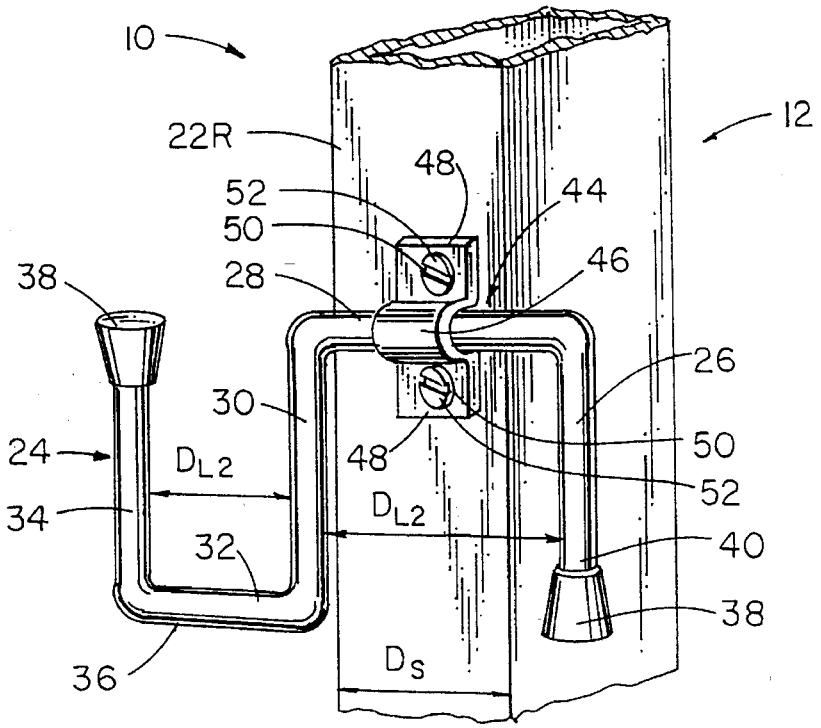
FIG. 4 is an enlarged partial cross-sectional view of the front support of a golf cart illustrating the retaining latch of the invention positioned when the hinged windshield is in its opened position.

As shown in FIG. 4, the upper windshield 16 may be released by the golfer simply grasping the second lobe and twisting it until the first outer transverse member 26 pivots away from the front of the upper windshield 16.

It is noted that FIGS. 3 and 4 illustrate only one side of the upper windshield 16; however, it is understood that the retainer latch 10 of the invention is preferably installed at both sides of the upper windshield 16 as shown in FIG. 1.

As shown in FIG. 4, it is also noted that the first distance between the first outer transverse member 26 and the middle transverse member 30 of the first lobe, designated $D_{L1}$, is substantially equal to the combined thickness of the roof structure support 22, designated $D_S$, and the upper windshield 16, designated $D_W$ (see FIG. 3), thereby assuring that the upper windshield 16 will be held tightly against the supports 22 when the retainer latches 10 are latched. Furthermore, end caps 38 provide some resiliency in the event the dimensioning is not precise.

It is noted that the distance between the middle transverse member 30 and the second outer transverse member 34 of the second lobe, designated $D_{L2}$, may be different than distance $D_{L1}$, to accommodate supports 22 and upper windshields 16 of different thicknesses. Indeed, the same retainer latch 10 can be used in regard to different makes and models of golf carts 13 that have differently-sized supports 22 and upper windshield 16.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. Paired retaining latches for use in connection with a hinged windshield of a golf cart at opposing sides thereof, the hinged windshield having a lower windshield hingley connected to an upper windshield by means of a hinge, the lower windshield being positioned across a lower front opening of the golf cart and secured at opposing sides to roof structure supports of the golf cart, the upper windshield being movable between an opened position in a substantially parallel, stacked configuration with the lower windshield and a closed position substantially planar with the lower windshield, the upper windshield when closed being positioned across an upper front opening of the golf cart with opposing sides of the upper windshield overlying the fronts of the roof structure supports, each retaining latch comprising in combination:

a coated squared S-shaped latch having planar and serially connected first outer transverse member, first outer longitudinal member, middle transverse member, second outer longitudinal member and second outer transverse member that define an "S" configuration that are each substantially perpendicular to respective serially connected said members;

end caps positioned about terminal ends of said first and second outer transverse members; and means for clamping one of said outer longitudinal members to a side of said support, whereby a first lobe defined by said first outer transverse member, first outer longitudinal member, and middle transverse member of said squared S-shaped latch is positioned about the support with said clamp means being positioned over said first outer longitudinal member and secured to a side of the support, whereby a second lobe defined by said middle transverse member, second outer longitudinal member and second outer transverse member functions as a handle that can be easily grasped and twisted such that said first outer transverse member moves across the front of the closed upper windshield to securely retain the upper windshield in the closed position, whereby said upper windshield may be released by grasping said second lobe and twisting it until said first outer transverse member pivots away from the front of the upper windshield and whereby said lobes are differently sized.

2. A retaining latch for use in connection with a hinged windshield for a golf cart, the hinged windshield having a potion overlying a roof structure support, comprising in combination:

an S-shaped latch having serially connected first outer transverse member, first outer longitudinal member, middle transverse member, second outer longitudinal member and second outer transverse member that define an "S" configuration;

said first outer transverse member, first outer longitudinal member, middle transverse member, second outer longitudinal member and second outer transverse member of said S-shaped latch being positioned in the same plane; and means for clamping one of said outer longitudinal members to a side of said support, whereby a first lobe defined by said first outer transverse member, first outer longitudinal member, and middle transverse member of said S-shaped latch is positioned about the support with said clamp means being positioned over said first outer longitudinal member and secured to the side of the support, whereby a second lob defined by said middle transverse member, second outer longitudinal member and second outer transverse member functions as a handle that can be easily grasped and twisted such that said first outer transverse member moves across the front of the portion of the windshield to securely retain the windshield in the closed position and whereby the windshield may be released by grasping said second lobe and twisting it until said first outer transverse member pivots away from the front of the windshield.

3. The retaining latch as set forth in claim 2, wherein said first outer transverse member, first outer longitudinal member, middle transverse member, second outer longitudinal member and second outer transverse member of said S-shaped latch are each substantially perpendicular to respective serially connected said members.

4. (Amended) The retaining latch as set forth in claim 2, wherein the said S-shaped latch comprises a substantially squared S-shape.

5. The retaining latch as set forth in claim 2, wherein said S-shaped latch is coated.

6. The retaining latch as set forth in claim 2, further including end caps positioned about terminal ends of said first and second outer transverse members.

7. The retaining latch as set forth in claim 2, wherein said first lobe is larger than said second lobe.

8. A retaining latch for use in connection with a hinged windshield for a golf cart, the hinged windshield having a portion overlying a roof structure support, comprising in combination:

an S-shaped latch having serially connected first outer transverse member, first outer longitudinal member, middle transverse member, second outer longitudinal member and second outer transverse member that define and "S" configuration; and means for clamping one of said outer longitudinal members to a side of said support, whereby a first lobe defined by said first outer transverse member, first outer longitudinal member, and middle transverse member of said S-shaped latch is positioned about the support with said clamp means being positioned over said first outer longitudinal member and secured to the side of the support, whereby a second lobe defined by said middle transverse member, second outer longitudinal member and second outer transverse member functions as a handle that can be easily grasped and twisted such that said first outer transverse member moves across the front of the portion of the windshield to securely retain the windshield in the closed position and whereby the windshield may be released by grasping said second lobe and twisting it until said first outer transverse member pivots away from the front of the windshield; and said first lobe being smaller than said second lobe.

9. A retaining latch for use in connection with a hinged windshield for a golf cart, the hinged windshield having a portion overlying a roof structure support, comprising in combination:

an S-shaped latch having serially connected first outer transverse member, first outer longitudinal member, middle transverse member, second outer longitudinal member and second outer transverse member that define an "S" configuration; and means for clamping one of said outer longitudinal members to a side of said support, whereby a first lobe defined by said first outer transverse member, first outer longitudinal member, and middle transverse member of said S-shaped latch is positioned about the support with said clamp means being positioned over said first outer longitudinal member and secured to the side of the support, whereby a second lobe defined by said middle transverse member, second outer longitudinal member and second outer transverse member functions as a handle that can be easily grasped and twisted such that said first outer transverse member moves across the front of the portion of the windshield to securely retain the windshield in the closed position and whereby the windshield may be released by grasping said second lobe and twisting it until said first outer transverse member pivots away from the front of the windshield; and said first lobe being substantially equal in size to said second lobe.

* * * * *